United States Patent [19]

Shaw

[11] Patent Number: 4,545,148

[45] Date of Patent: Oct. 8, 1985

[54] WEATHERSHIELD AND SAFETY SCREEN FOR OPENING WINDOWS IN BUILDINGS

[76] Inventor: Lendon J. Shaw, 5 Rikara Pl., French's Forest, New South Wales, 2086, Australia

[21] Appl. No.: 507,162

[22] Filed: Jun. 23, 1983

[30] Foreign Application Priority Data

Jun. 25, 1982 [AU] Australia ..... PF4592

[51] Int. Cl.[4] ..... E06B 7/00

[52] U.S. Cl. ..... 49/50; 49/462; 98/44

[58] Field of Search ..... 49/50, 61, 55, 70, 460, 49/462, 135, 92; 52/202, 203; 98/99.7, 88 R, 44

[56] References Cited

U.S. PATENT DOCUMENTS

| | | | |
|---|---|---|---|
| 159,800 | 2/1875 | Couch | 49/50 X |
| 1,063,464 | 6/1913 | Olander | 49/61 X |
| 1,475,103 | 11/1923 | Wood | 98/88 R X |
| 1,655,194 | 1/1928 | Newsom | 98/88 R |
| 2,195,361 | 3/1940 | Davis | 49/61 X |
| 2,435,008 | 1/1948 | Kaufmann | 49/61 |
| 2,607,452 | 8/1952 | Hall | 49/92 X |
| 2,859,493 | 11/1958 | Matschke | 52/202 |
| 2,892,495 | 6/1959 | Hadden | 49/55 X |
| 3,116,519 | 1/1964 | Keith | 98/44 X |
| 4,338,148 | 7/1982 | Adell | 49/462 X |

*Primary Examiner*—Philip C. Kannan

*Attorney, Agent, or Firm*—Ladas & Parry

[57] ABSTRACT

A window shield adapted for sliding windows in domestic buildings and providing weather protection, increased security, safety and noise reduction. The shield includes a sheet produced in plastics material to cover the window opening or a part thereof. The sheet includes edge strips along each transverse edge in the form of moulded portions of the plastics sheet bent in opposite directions to one another, out of the plane of the sheet. A central moulded rib is included in the sheet when extra rigidity is required. Further improvements in rigidity are provided by metal edges fixed along the edge strips. Two methods of attaching these shields are described: inserting lips of upper and lower attachments into grooves of extruded aluminium window frames, the lips being parallel to, and equally distant from, the sheet; and fastening pivoting feet to the window sill, the pivoting feature allowing attachment to sills of any slope, and fastening a rigid member to the window head.

7 Claims, 7 Drawing Figures

WEATHERSHIELD AND SAFETY SCREEN FOR OPENING WINDOWS IN BUILDINGS

This invention relates to externally fitted weather and safety shield applicable to building windows which may be opened. It particularly relates to sliding type windows although certain other types of windows such as hinged hopper types might also be suitable.

It has always been desirable in buildings to provide adequate ventilation 24 hrs a day. However where no one occupies a home, for instance through the day, there are disadvantages in leaving one or more windows even partially opened. Such practice has allowed easy unauthorised access to buildings, although this has to some extent been overcome by the provision of specially adapted locks to allow windows to be locked while partially opened. However another disadvantage is that adverse changes in the weather may result in strong winds and/or rain entering an open window for considerable time. This can lead to rain and/or wind damage to drapes, blinds, wall and floor coverings, furniture etc. Furthermore, especially in flats and home units, open windows allow a lot of outside noise to enter.

A further disadvantage of leaving windows even partially open is that small children or even adults may climb through the windows and fall out of the building resulting in physical injury and possible death. In view of these abovementioned situations, windows left open are usually only left open a small amount and thus adequate ventilation is often not provided. In most cases all windows are kept completely closed providing no ventilation at all.

Therefore the object of the present invention is to provide apparatus which will ameliorate the abovementioned problems.

By way of example only preferred embodiments of the present invention will now be described with reference to the accompanying drawings in which.

Figure 1:
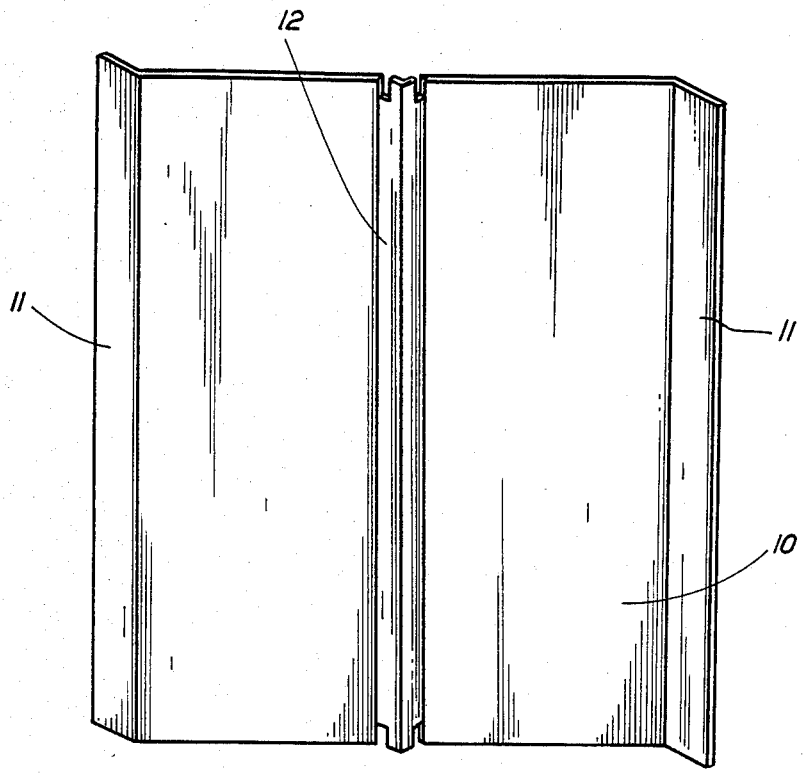
FIG. 1 shows a typical screen in accordance with the present invention.

In FIG. 1 sheet 10 is seen to include 3 moulded portions being edge strips 11 and a central rib type strip 12. Sheet 10 is produced preferably from polycarbonate material but may equally well be formed from any strong flat sheet of perspex, acrylic or other suitable, plastics. In the sheet 10 shown, rib 12 and edge strips 11 both provide additional strength and rigidity. In some situations the rib 12 may be omitted while in other situations additional ribs may be used for increased strength and rigidity.

The sheet 10 may be produced in transparent, translucent or coloured variations depending upon requirements.

A shield including the sheet 10 is attached external of, and spaced from, a window in one of two basic modes. The shield may be attached by means cooperative with extruded portions of aluminium window frames or directly to the upper head and lower sill of the building structure.

Figure 2:
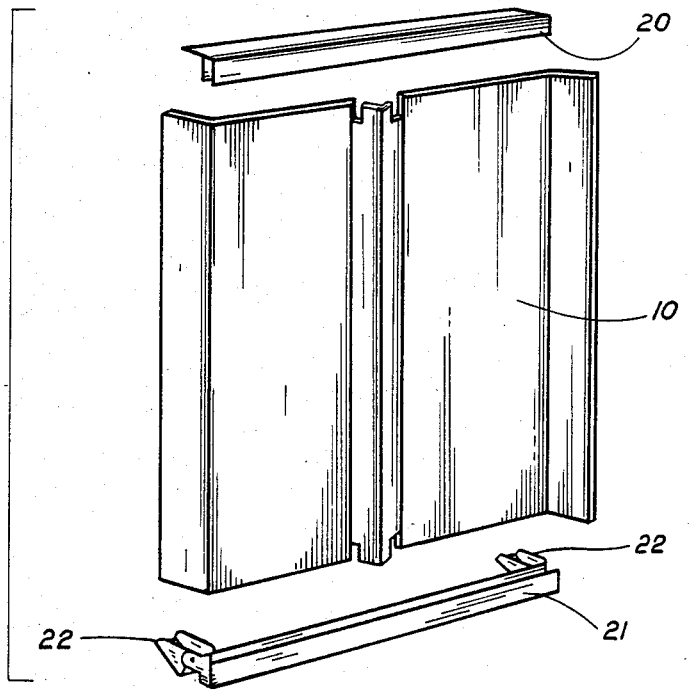
FIG. 2 shows one preferred means of attaching an embodiment of the present invention to a building.

FIG. 2 shows a shield including upper and lower attachment means 20 and 21 respectively. Upper attachment means 20 is an extruded length including a channel portion adapted to fit snugly over the top edge of sheet 10 and a flat extension strip protruding at right angles to the plane of sheet 10. In practice the protruding strip extends inwardly towards the window. The protruding strip portion can be drilled or punched so as to allow attachment to an upper head of a window cavity by conventional means.

Lower attachment means 21 includes a channel portion similar to attachment means 20 to fit around the lower end of sheet 10. These channel portions may then be glued or attached by rivets or similar known means.

Figure 5A:
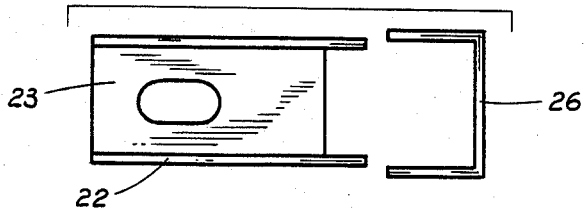
FIG. 5A shows a plan view of further means of attaching the screen of the present invention.
Figure 5B:
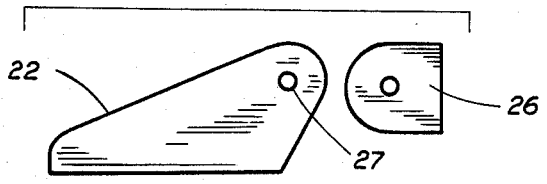
FIG. 5B shows a side elevational view of further means of attaching the screen of the present invention shown in FIG. 5A.
Figure 6:
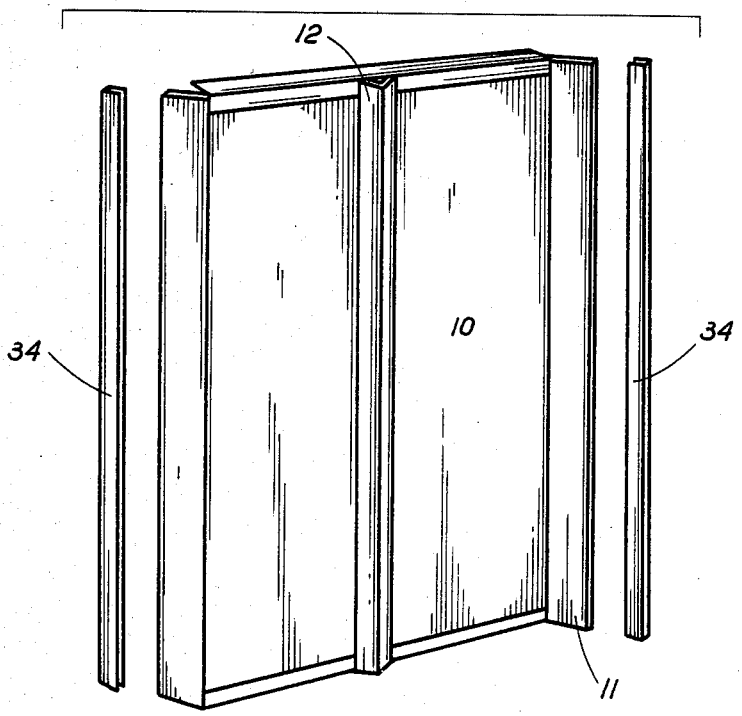
FIG. 6 shows a further embodiment of the invention.

Lower attachment means 21 includes feet 22, one at each end of attachment means 21, and pivotally attached thereto. The pivotal movement of feet 22 is such that the screen can be easily attached to a lower sill no matter what the inclination of the sill surface. Therefore there is no necessity to provide a set of attachment means for specific sill inclinations. As seen in FIG. 5 feet 22 are preferably produced from substantially channel shaped portions providing a recessed surface 23 in which a slot is located for cooperation with a nut and stud or similar conventional attaching means for securing the feet 22 to the sill. By providing the partially enclosed volume in which the attaching means is located security is improved by making removal of the screen more difficult especially from the outside of the fitted unit.

Intermediate brackets 26 provide an alternate attachment of feet 22 to attachment means 21. Brackets 26 allow the use of feet 22 to be placed intermediate the length of attachment means 21 if so desired.

Figure 4:
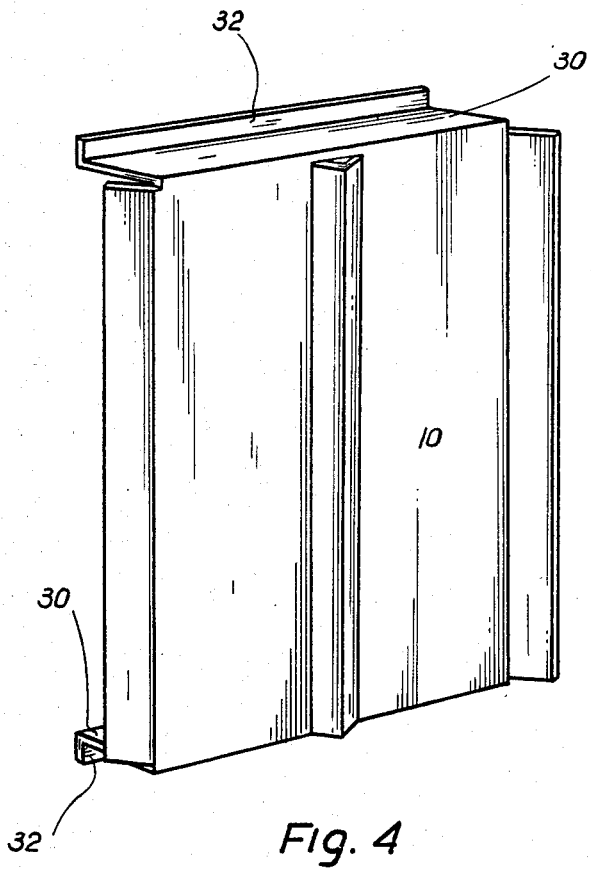
FIG. 4 shows an alternative means of attaching a screen in accordance with the present invention.

In another embodiment (FIG. 4) of the invention the sheet 10 is attached via attachment means 30 which extend substantially at right angles to the plane of sheet 10 toward the window and include end portions 32 which cooperate with extruded portions of the window frame (for example, a channel for flyscreens) so as to secure the screen in place. End portions 32 may be integral with sheet 10 or separate portions attached for example by rivets. Separate portions 32 may be metal or plastics.

Figure 3:
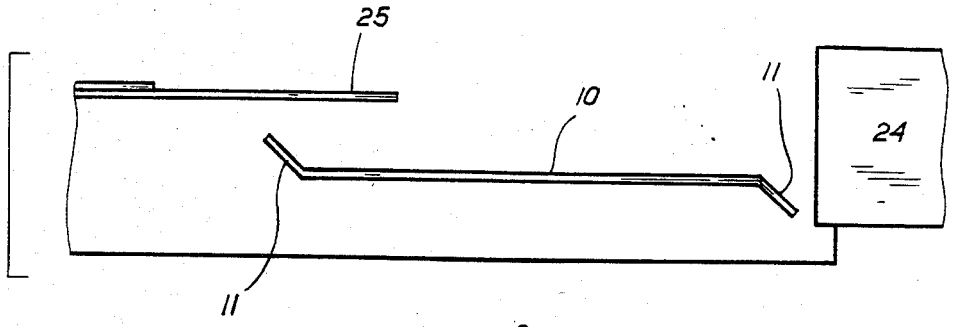
FIG. 3 is a plan section of a shield in use in accordance with the present invention.

When the screen is in place as shown in FIG. 3 the edge strips 11 are located with one protruding outwardly and slightly displaced from the end wall 24 of the window cavity and the other protruding inwardly and displaced from the general plane of the window 25. The sheet 10 may be of a width sufficient to substantially overlap the maximum opening of the window. Where the window is equipped with a locking device allowing it to be locked in a partially open position the sheet 10 may be of a reduced width which is less than the maximum opening of the window but significantly wider than the lockable intermediate opening.

The sheet 10 is of a length to effectively cover the complete height of a horizontally sliding window cavity. Prevailing wind or rain is deflected via the shield so that under all but extreme conditions no excessively strong wind or rain enters the open window. Furthermore the gaps between sheet 10 and existing structure are insufficient to allow small children to pass therebetween. However sufficient space is provided so as to allow free circulation of air.

In some instances metal edge strips 34 are attached to edge strips 11 of sheet 10 to provide further rigidity.

The above described invention provides a simple to install device which will give protection against wind, rain and noise and increase safety around the home.

What I claim is:

1. A shield rigidly vertically installed within a window cavity of a building in which at least a portion of the window is openable, the shield comprising: a substantially rectangular planar sheet of plastics material extending vertically the height of the open window and horizontally at least across part of the openable portion of said window, the sheet includes moulded transverse edge strips bent in opposing directions out of the plane of the sheet; and upper and lower attachment means fastened to the structure within the window cavity.

2. A shield as defined in claim 1 wherein the upper and lower attachment means include lip portions adapted to cooperate with respective upper and lower aluminium window frame extrusions so as to secure the shield in a position parallel with the window and spaced outwardly therefrom.

3. A shield as defined in claim 1 wherein the upper attachment means is fastenable to the window head and the lower attachment means includes hinged feet fastenable to the window sill.

4. A shield as defined in claim 3 wherein the feet are hinged to brackets fixed to the lower edge of the sheet.

5. The shield as defined in claim 1 wherein the sheet includes at least one moulded rib running parallel to said edge strips.

6. A shield as defined in claim 5 further including metal edge strips attached to the edges of the edge strips.

7. A shield for rigid vertical installation within a window cavity of a building in which at least a portion of the window is openable, the shield comprising a substantially rectangular planar sheet of plastics material including moulded transverse edge strips bent in opposing directions out of the plane of the sheet and upper and lower attachment means respectively at upper and lower longitudinal ends of said sheet, said lower attachment means including hinged feet pivotable about an axis parallel to the lower longitudinal end edge so that said feet can be easily attached to the surface of a sill of any inclination for vertical installation of said shield.

* * * * *